US006857633B1

(12) United States Patent
Mackey

(10) Patent No.: US 6,857,633 B1
(45) Date of Patent: Feb. 22, 2005

(54) CASTLE BLOCKS BOARD GAME

(75) Inventor: Thomas J. Mackey, Gibsonia, PA (US)

(73) Assignee: DaGoom, Inc., Bakerstown, PA (US)

( * ) Notice: Subject to any disclaimer, the term of this patent is extended or adjusted under 35 U.S.C. 154(b) by 535 days.

(21) Appl. No.: 09/479,531

(22) Filed: Jan. 7, 2000

Related U.S. Application Data

(60) Provisional application No. 60/115,162, filed on Jan. 8, 1999.

(51) Int. Cl.[7] ..... A63F 3/00

(52) U.S. Cl. ..... 273/156; 273/241; 273/262; 273/276; 273/284; 273/289; 273/290

(58) Field of Search ..... 446/409, 85–128; 273/241, 262, 157 R, 153 R, 156, 157 A, 236, 276, 281, 283, 284, 287, 288, 160, 290; 33/700, 711, 772, 778, 781, 782, 792, 755, 761, 764, 765, 769

(56) References Cited

U.S. PATENT DOCUMENTS 2,557,481 A * 6/1951 Staples
3,651,574 A * 3/1972 Burkart
3,862,512 A * 1/1975 Vogel ..... 46/25
4,084,813 A * 4/1978 Washnock
4,434,984 A * 3/1984 Bergstrom
4,532,710 A * 8/1985 Kinney
4,810,224 A * 3/1989 De Vincent ..... 446/230
4,896,888 A * 1/1990 Owen
5,042,972 A * 8/1991 Back et al. ..... 446/91
5,052,687 A * 10/1991 Katerba
5,145,177 A * 9/1992 Wells
5,407,201 A * 4/1995 Whitehurst
5,615,883 A * 4/1997 Stevens
5,637,996 A * 6/1997 McDarren et al. ..... 324/178
5,685,120 A * 11/1997 Sihra
5,860,650 A * 1/1999 Scobbie et al. ..... 273/157 R
6,015,150 A * 1/2000 Giguere

* cited by examiner

*Primary Examiner*—Stephen Blau
(74) *Attorney, Agent, or Firm*—Blynn L. Shideler; Krisanne Shideler; BLK Law Group

(57) ABSTRACT

A game for children has buildable structures, movement measurement devices for measuring game piece movement and projectile range values, structural unit guides to aid in construction of the buildable structures, and movable game pieces.

20 Claims, 11 Drawing Sheets

CASTLE BLOCKS BOARD GAME

CROSS-REFERENCE TO RELATED APPLICATION

This application claims the benefit of earlier filed U.S. Provisional Patent Application Ser. No. 60/115,162, filed Jan. 8, 1999, entitled "Castle Blocks Board Game".

BACKGROUND OF THE INVENTION

1. Field of the Invention

The present invention relates to games and, more particularly, to board games having buildable structures.

2. Description of the Prior Art

Board games challenge the mind and teach various skills and concepts, such as formulating strategies, sharing, socializing, competing, winning, and losing. A common drawback of most board games designed for children, however, is that the format of the game is so structured that a child's imagination is constrained. For example, many commercially produced board games must be played on pre-printed boards, with game pieces traveling on a never-changing pathway. Many board games also incorporate instruction cards that order a player to move their game piece, lose a turn, or execute some other command. As these games are played repeatedly, the game becomes more predictable, less challenging, and less appealing to play.

Another disadvantage of many commercial board games designed for children is that the method of play is so random that original, independent thought does not help the child achieve the explicit goal of the game-winning. For example, many board games are often driven solely by the random appearance of colors or the roll of a die. In these types of games, the child has no input into the outcome of the game and is completely controlled by probabilities.

Still another disadvantage of many board games is that the games are not educational. Many games do not require a player to count past six, the number of sides on a conventional die. Moreover, these games are essentially two-dimensional, with no requirement to estimate distances, evaluate how objects are constructed, or recognize geometrical objects.

It is therefore an object of the present invention to provide an interactive, educational game that encourages input from the players and allows the players to make their own decisions, choose their own strategies, and directly affect the outcome of the game.

SUMMARY OF THE INVENTION

To obviate the drawbacks of the prior art, the present invention is directed toward a game that generally includes at least one of structural unit guide, a plurality of structural units positioned adjacent the at least one structural unit guide forming a structure, a plurality of movable game pieces positioned in proximity to the structure, a movement measurement device constructed to measure range values of the game pieces.

The game is most easily described by reciting the following basic story line upon which the game is based:

A royal family, including a King, Queen, and Prince, lives in a fictitious kingdom and resides in a castle. Allied with the royal family are troops (including Knights and Good Archers) and a Wizard.

Unfortunately, the kingdom is suffering increasing attacks from a competing kingdom ruled by a Dragon. Allied with the Dragon are henchmen, including Goblins and Bad Archers.

One day, henchmen aligned with the Dragon seize the Wizard and his home, a tower. The Wizard immediately dispatches a plea to the King requesting assistance. The King leaves the castle, taking all of his troops except for three Knights. The remaining Knights are left to protect the Queen and the Prince.

When the King arrives at the tower, the King realizes that his troops outnumber the henchmen. He immediately orders his troops to attack the henchmen. In a series of bloodless mathematical battles, the outnumbered henchmen are probably (but not necessarily) repelled, and the Wizard is set free.

After the battle is over and the henchmen are captured, the captured henchmen peacefully recover in the tower. As the King and his troops begin their return to the castle, the Wizard gazes into his crystal ball and sees a disturbing sight. The attack on the Wizard was a diversion designed to lure the King away from the castle. In the absence of the King, the Dragon and additional henchmen (now equal in number to the King and his troops) captured the castle and imprisoned the Queen, Prince, and the three Knights. The Wizard immediately informs the King and, as a gesture of gratitude, gives the King a catapult to aid in the re-capture of the castle.

The game is played by individual players or groups of players first acting out the above story line. In general, the game is played by building a structure, such as a tower or castle, using structural units and at least one structural unit guide, assembling game pieces in proximity to the structure, determining range values for each game piece using a movement measurement device, moving each game piece within a permissible movement range value, engaging in mathematical combat with game pieces controlled by an opposing side, and removing captured game pieces from play.

Once the tower or other structures have been built, players or groups of players select sides and begin the game. The player or group of players controlling game pieces representing the King and his troops attempt to capture game pieces representing henchmen. The attack value and range values for each game piece are determined by game piece indicia positioned on each game piece. Range values include a movement range value and a projectile range value. Each range value is measured by a movement measurement device.

The game pieces controlled by either side are preferably all moved during each turn, but can also each be moved individually or randomly determined by a roll of a die. The range values of imaginary projectiles launched by selected game pieces, such as the game pieces representing the Good Archers, the Bad Archers, and the catapult, are indicated on those respective game pieces. Victors of battles are determined mathematically.

After the siege at the tower ends, the tower is disassembled and the structure referred to as the castle is built from the same structural units used to build the tower. The game pieces are also reused. Optional structural unit guides aid in the construction of the castle.

After the castle is built, the players representing the King and his troops attempt to retake the castle and rescue the royal family in accordance with the story line. The players controlling the game pieces representing the King and his troops accomplish this task by capturing the game pieces representing the Dragon and the henchmen. The catapult can be used to attack the castle with structural units being removed from the top of the structures first.

The game ends when all of the game pieces controlled by a player or a group of players have been captured or when the Dragon and henchmen game pieces flee the castle and do not attempt to regain control after a specified number of turns.

These and other advantages of the present invention will be clarified in the Brief Description of the Preferred Embodiments taken together with the attached drawings in which like reference numerals represent like elements throughout.

DETAILED DESCRIPTION OF THE PREFERRED EMBODIMENTS

The preferred embodiment of the present invention is shown in FIGS. 1–4, 8*a*–8*b*, and 11–12 and in U.S. Provisional Patent Application Ser. No. 60/115,162, filed Jan. 8, 1999, herein incorporated by reference in its entirety.

Figure 1:
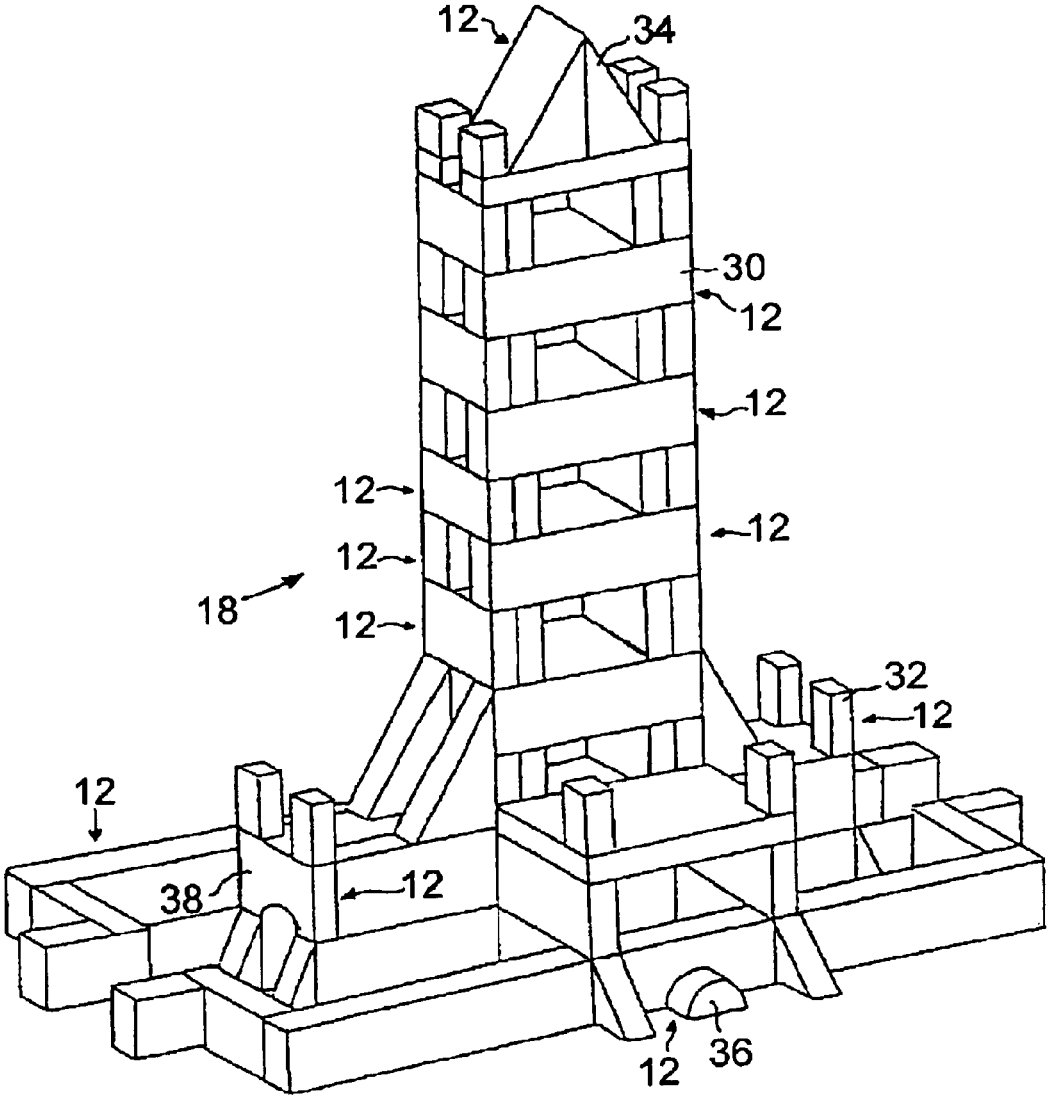
FIG. 1 is a perspective view of one possible tower structure.
Figure 2:
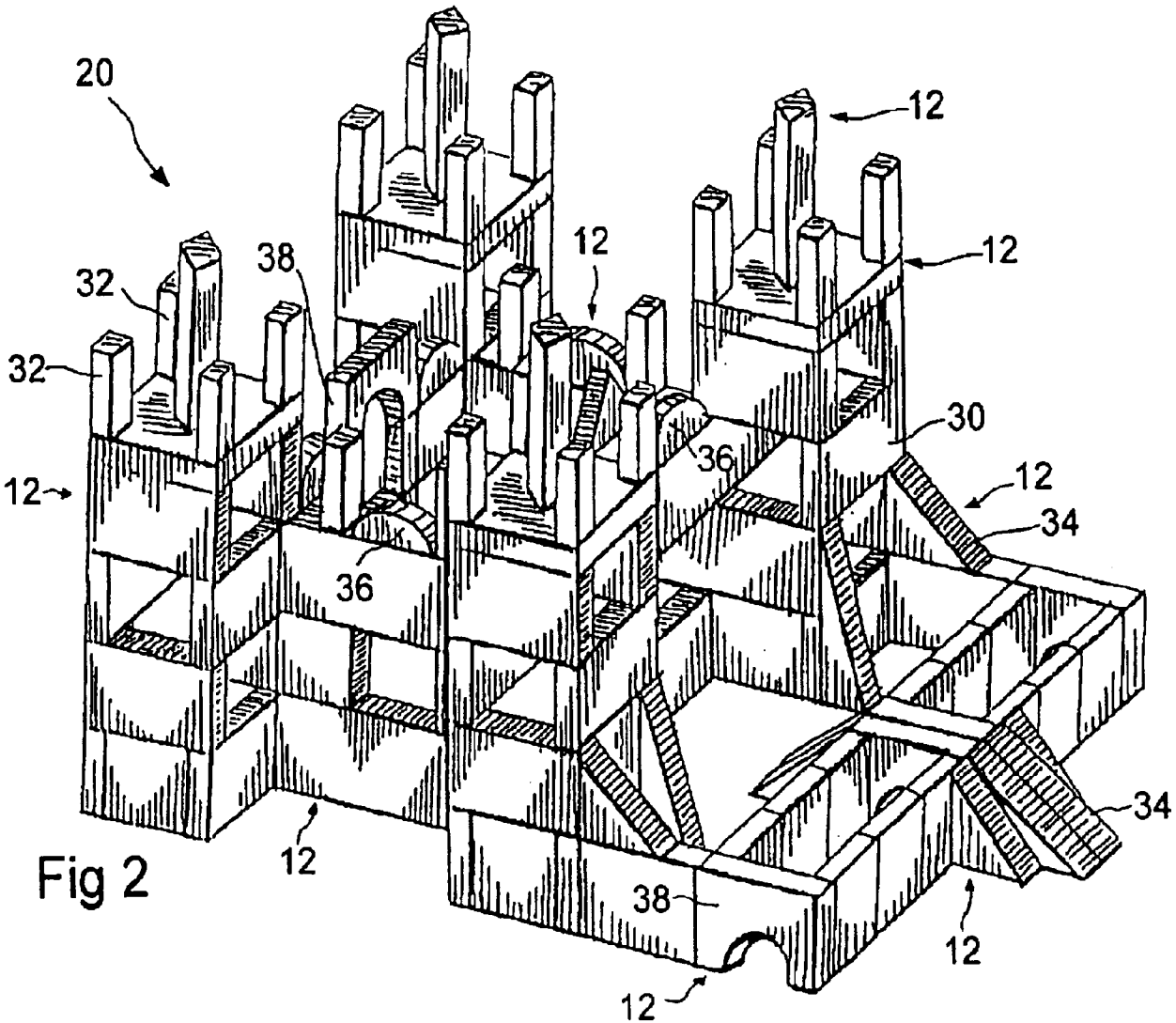
FIG. 2 is a perspective view of one possible castle structure.
Figure 3:
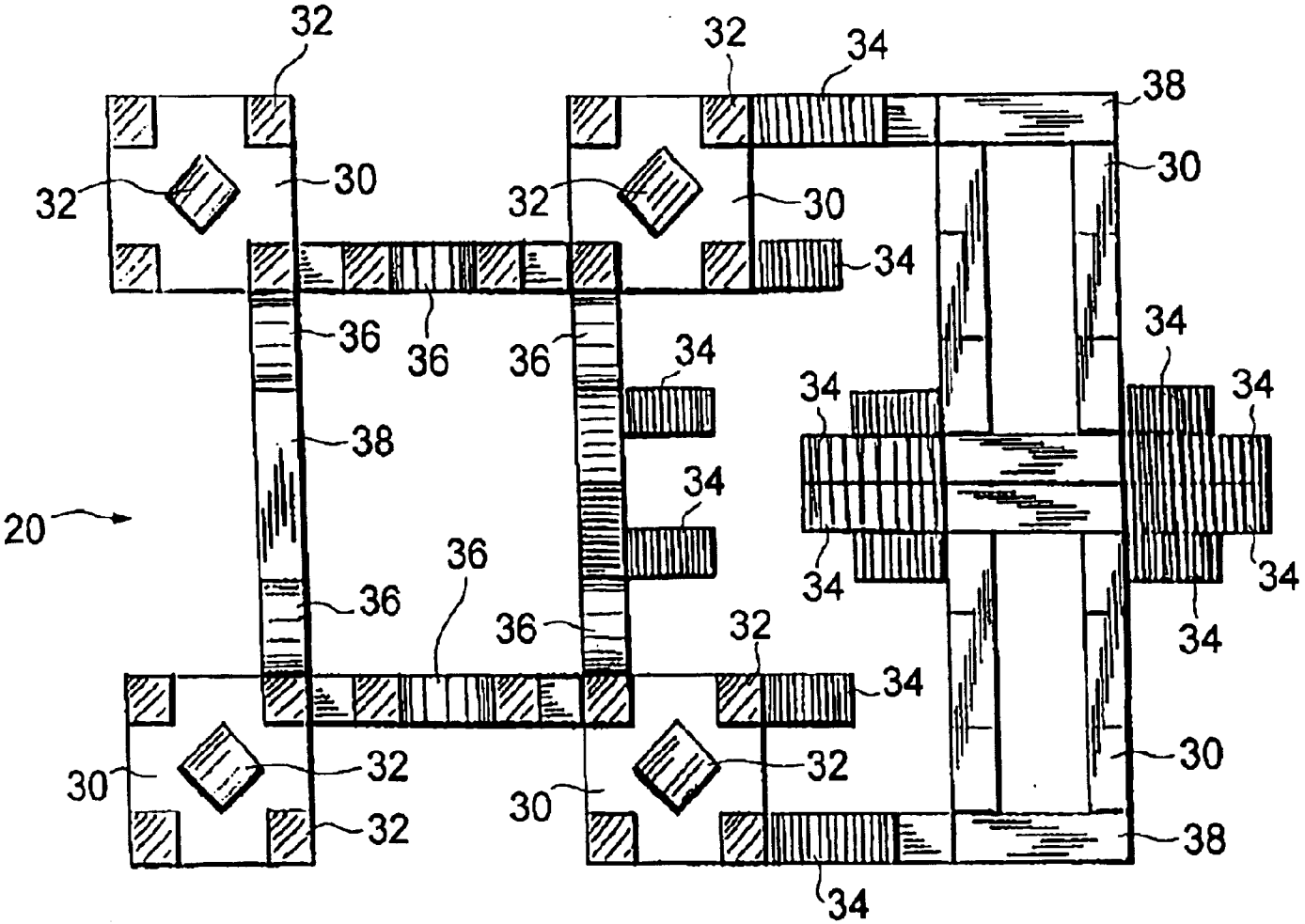
FIG. 3 is a top view of the castle structure shown in FIG. 2.
Figure 8A:
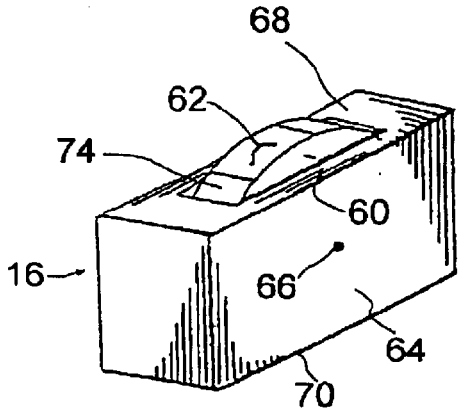
FIG. 8*a* is a bottom perspective view of one embodiment of a movement measurement device.
Figure 8B:
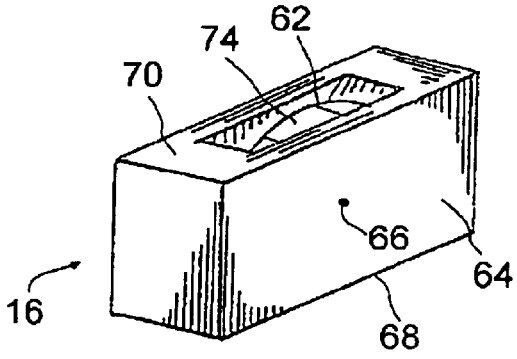
FIG. 8*b* is a top perspective view of the movement measurement device shown in FIG. 8*a;*
Figure 4:
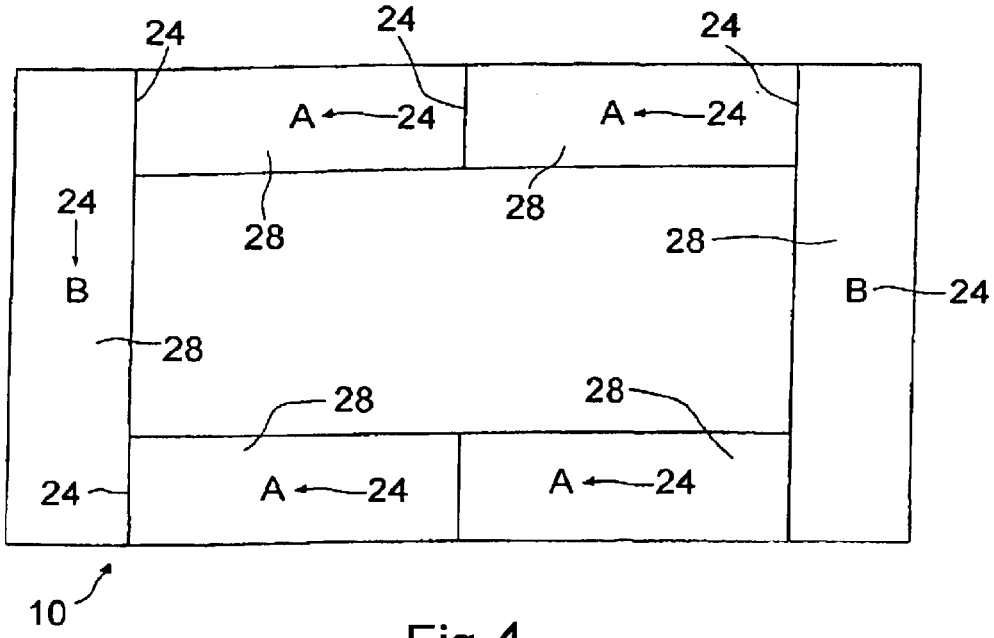
FIG. 4 is a top view of one embodiment of a structural unit guide.
Figure 11:
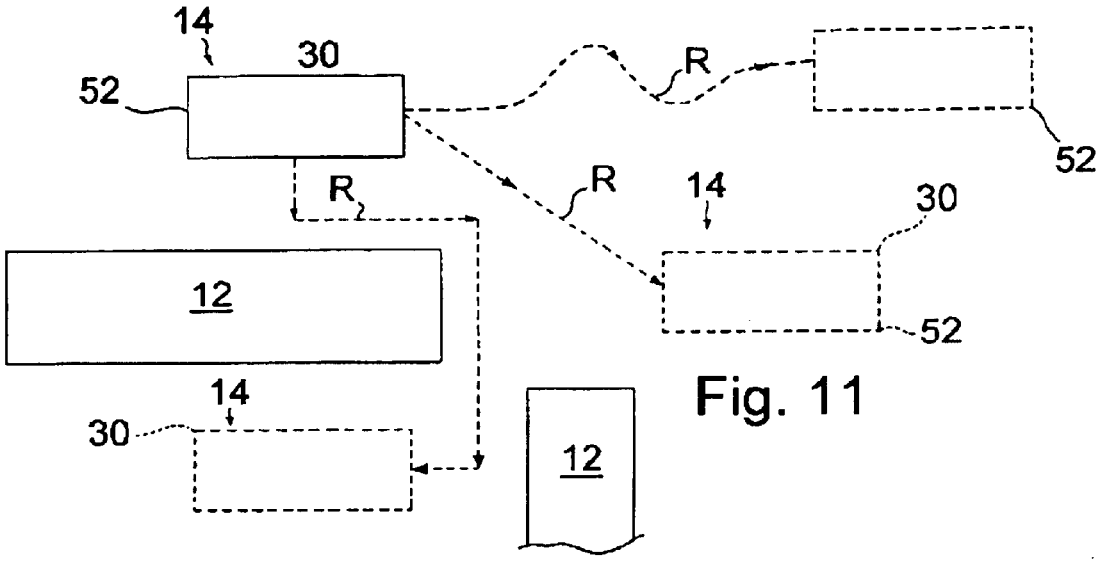
FIG. 11 is a top schematic view of a game piece with linear and non-linear travel paths indicated.
Figure 12:
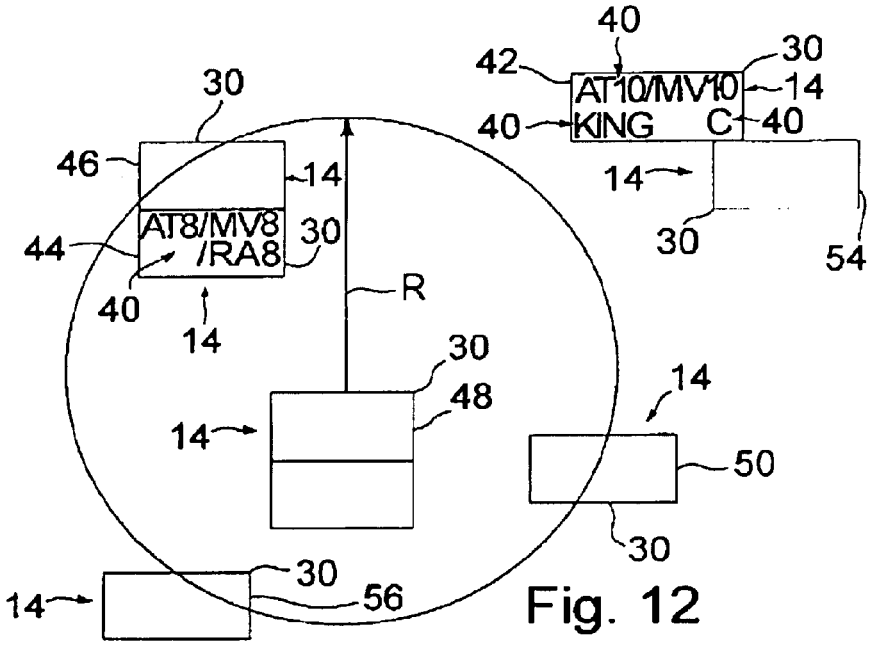
FIG. 12 is a top schematic view of game pieces within and beyond the projectile range of two adjoining game pieces.

As shown in FIGS. 1–4, 8*a*–8*b*, and 11–12, the present invention generally includes at least one structural unit guide 10, a plurality of structural unit 12 positioned adjacent the at least one structural unit guide 10 and forming a structure, a plurality of movable game pieces 14 positioned in proximity to the structure, and a movement measurement device 16 constructed to measure movement and range values R of the game pieces 14, including movement range value and projectile range value. FIG. 1 shows a structure, constructed from structural units 12, representing a free-standing tower 18. FIGS. 2 and 3 show a second structure, constructed from the same structural units 12 as the tower 18, representing a free-standing castle 20. FIG. 4 shows one embodiment of a structural unit guide 10. FIGS. 8*a* and 8*b* show one embodiment of a movement measurement device 16. FIGS. 11–12 show game pieces 14 and typical game piece 14 range R examples.

The tower 18 and castle 20 are both built using structural units 12 and, preferably, structural unit guides 10. As shown in FIG. 4, each structural unit guide 10 is preferably made from a planar material, such as cardboard or other suitable material, but may also be integrally formed with the structural units 12 (discussed below), such as by color coding or imprinting directly onto a surface of each structural unit 12. Each structural unit guide 10 has a two sides, with either side having structural unit guide indicia 24 that corresponds with structural unit indicia 26 positioned adjacent each structural unit 12. The structural unit guide indicia 24 includes alphabetical letters, colors, or dots corresponding to the structural unit indicia 26, and shadow outlines of various structural units 12, with the shadow outlines forming available spaces 28.

Figure 5A:
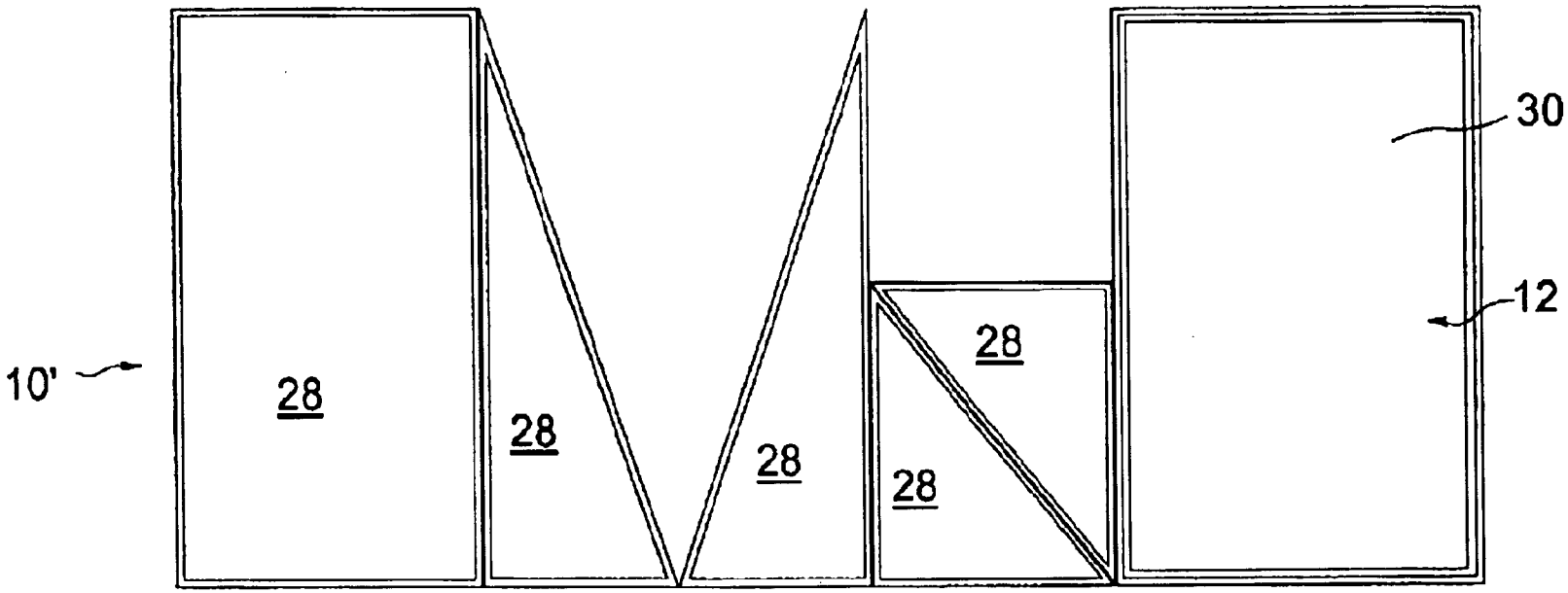
FIGS. 5*a* and 5*b* are side views of second embodiments of a structal unit guide.
Figure 8C:
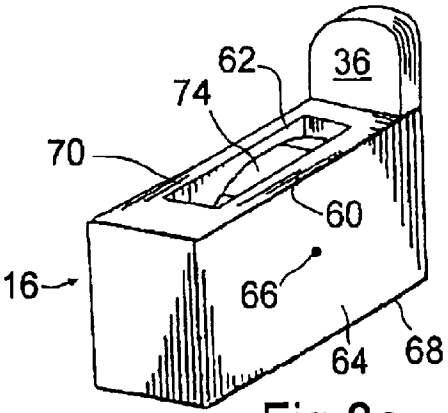
FIG. 8*c* is a top perspective view of a modified movement measurement device shown in FIGS. 8*a* and 8*b;*
Figure 8D:
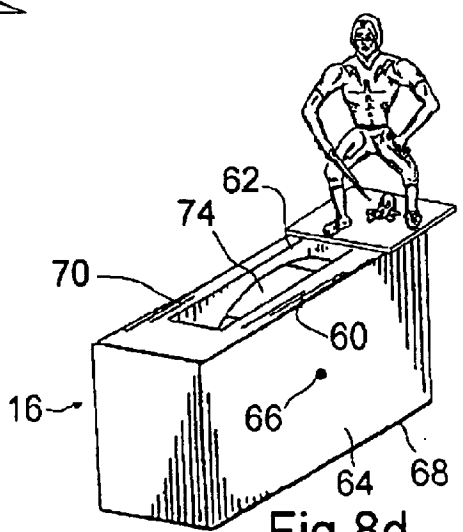
FIG. 8*d* is a top perspective view of a modified movement measurement device shown in FIGS. 8*a* and 8*b;*
Figure 5B:
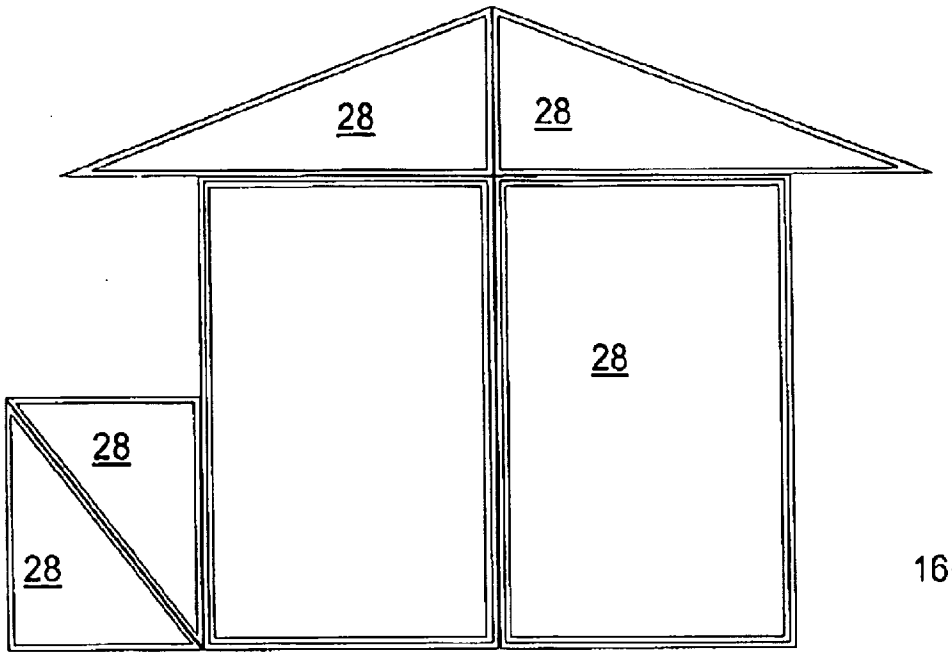
Figure 6:
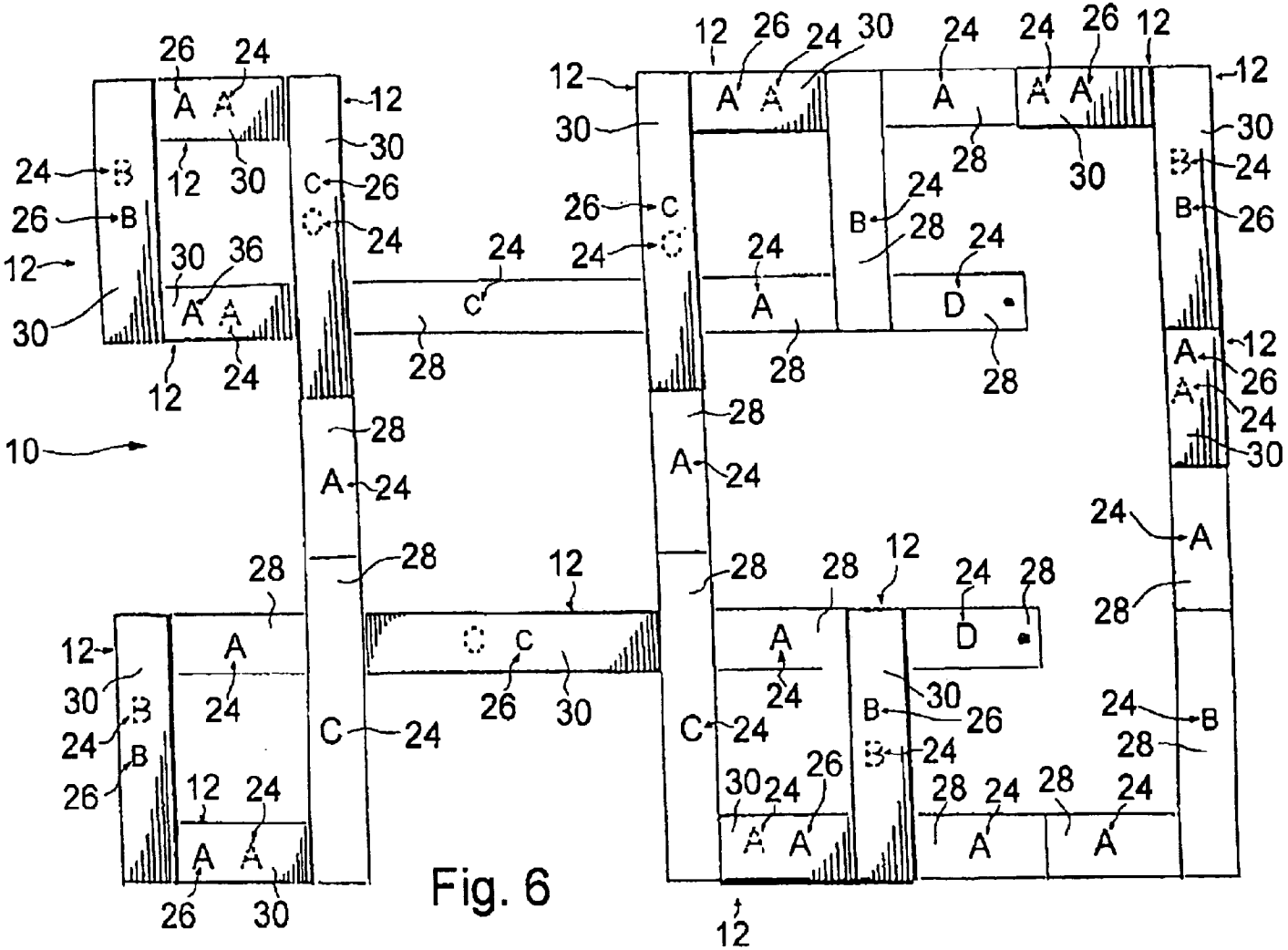
FIG. 6 is a top view of a structural unit guide according to the type shown in FIG. 4 partially filled with structural units.

As shown in FIG. 6, structural unit guides 10 are stacked on a flat surface or on a preceding row of structural units 12 and structural units 12 are positioned adjacent the structural unit guides 10. The purpose of the structural unit guides 10 and the structural unit guide indicia 24 is to provide a visual blueprint or template to players, that when used in conjunction with the corresponding structural unit indicia 26 positioned on the structural units 12, aids in the construction of the tower 18 and castle 20. Therefore, other structural unit guides 10, structural unit indicia 26, or structural unit guide indicia 24 may be used to accomplish this purpose. For example, three-dimensional structural unit guides 10', such as the one shown in FIG. 5, may also be used. Each structural unit guide 10' is a three-dimensional structure forming hollow cavities or spaces 28 corresponding to an outer periphery shape of one or more of the structural units 12.

The three-dimensional structural unit guides 10' can be layered between two rows of structural units 12, like the two-dimensional type 10 previously discussed, or connected together in sections. Structural units 12 are inserted into spaces 28 formed by the structural unit guides 10, as shown in FIG. 5. If the sections are removably attached, different portions of a structure, such as a moat attached to the castle 20, can be separately constructed or removed. If the sections are permanently attached, the entire structural unit guide 10' for the entire castle 20 can be unfolded, in a pop-up fashion. The three-dimensional structural unit guides 10' provide a more visually instructive guide and add flexibility to the game.

Any of the structural unit guides 10, 10' discussed above can be connected together with posts, hook and latch straps, folded material, telescoping members, or any other connection apparatus. Moreover, any of the structural unit guides 10, 10' can further have aesthetically pleasing placards having pictures positioned thereon, wherein the placards can pivot and fit inside voids formed by the structural units 12. To aid in stability, the structural unit guides 10, 10' can further include orifices that align with corresponding orifices in adjacent structural units 12. This allows adjacent structural units 12 to be interconnected using projecting pins, dowels, or other connection devices.

To help decrease manufacturing costs, selected structural units 12 are interchangeable with game pieces 14. The structural units 12 and game pieces 14 form three-dimensional geometric shapes, such as rectangular 30, elongated 32, wedged 34, arced 36, and arched 38. The structural units 12 and game pieces 14 are preferably made from wood, but other suitable materials can be used. Moreover, the structural units 12 and game pieces 14 can also have decorative indicia, such as a brick facade, a picture of a character, or other visual pictures or symbols attached thereto for aesthetic purposes.

Selected structural units 12, such as the rectangular 30, elongated 32, and arched 38, have two parallel sides, allowing levels of structural units 12 to be stacked on each other, with a structural unit guide 10 preferably positioned between the levels. Attached to each structural unit 12 of similar type is structural unit indicia 26, such as alphabetical letters or dots.

As shown in FIGS. 11 and 12, game pieces 14 each have game piece indicia 40 positioned thereon. The indicia 40 indicates attack and range values R, including movement range value and projectile range value, corresponding to the game piece 14. If applicable, the classification of each individual game piece 14 is also included. For example, game pieces 14 having the game piece indicia 40 (AT 4/MV 3/RA 10) have a maximum attack value of four, a maximum movement value of three, and a maximum attack range of ten. Game pieces 14 with an "A" classification are identical to other game pieces 14 with an "A" classification. The following value chart illustrates preferred types of game pieces 14 as well as the corresponding attack value, range values R, and classification value positioned on each respective game piece 14:

| | | |
|---|---|---|
| King 42 | AT 10/MV 10 | (C) |
| Queen 44 | AT 8/MV 8/RA 8 | |
| Knight 46 | AT 5/MV 5 | (A) |
| Good Archer 48 | AT 4/MV 3/RA 10 | (B) |
| Dragon 50 | AT 10/MV 6/RA 6 | (C) |
| Goblin 52 | AT 5/MV 5 | (A) |
| Bad Archer 54 | AT 4/MV 3/RA 10 | (B) |
| Catapult 56 | AT 7/MV 3/RA 18 | |

Figure 7:
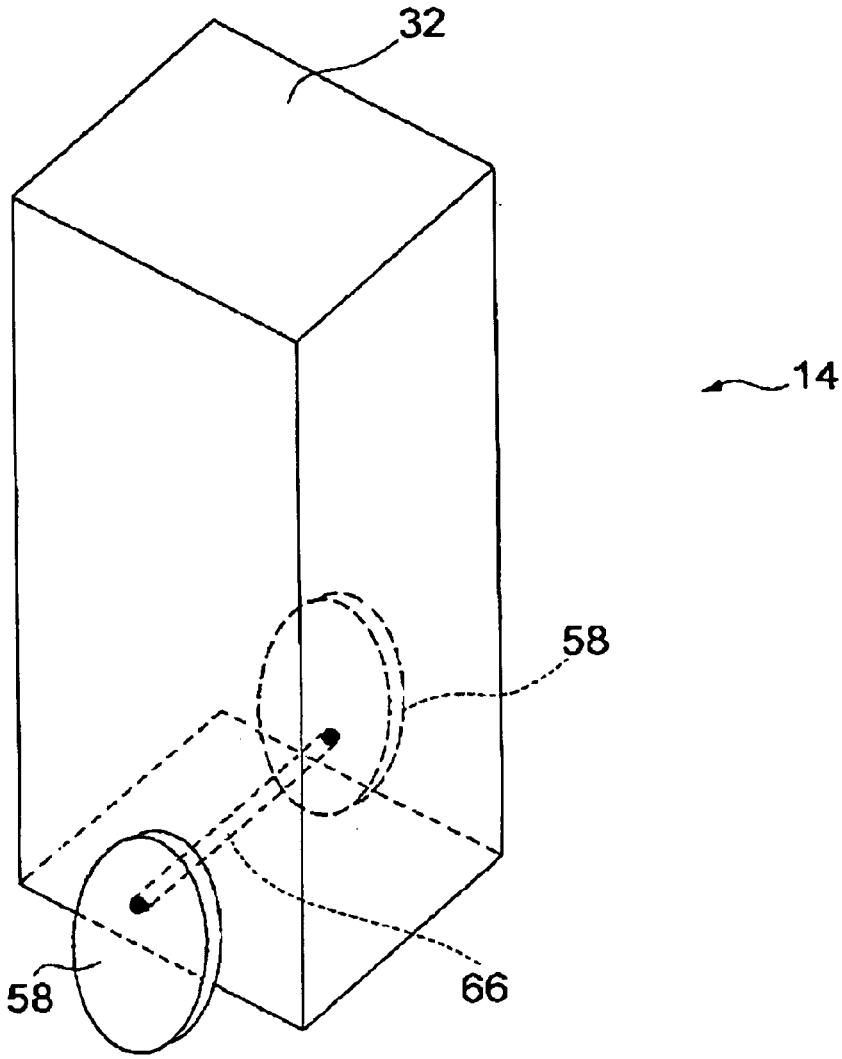
FIG. 7 is a perspective view of a game piece with movable body parts.

Although geometrically-shaped game pieces 14 are preferred, since the game pieces 14 and structural units 12 can both be manufactured using the same mold or template, thereby reducing manufacturing costs, other more sophisticated game pieces 14 may also be used. For example, human figurines, physical objects, animal figures, or any other two- or three-dimensional objects can be substituted in part or in whole for the preferred game pieces 14. Moreover, the game pieces 14 can have movable body members as well. For example, as shown in FIG. 7, one or more pairs of eccentric wheels 58 can be used to simulate a galloping horse or mimic walking. In order to mimic walking, the eccentric wheels 58 would be rotationally offset by about 180° in each pair and connected by an axle 66.

Range values R, such as movement range value and projectile range value, of game pieces 14 are measured by a movement measurement device 16. One embodiment of a movement measurement device 16 includes a body 60 having a continuous surface 62, such as the periphery of a circular wheel, a sphere, or endless track. The continuous surface 62 allows a player or group of players to measure range values R either linearly or non-linearly, as shown in FIG. 11. The body 60 is preferably formed from wood, but other suitable materials are also contemplated.

In the preferred embodiment shown in FIGS. 8*a* and 8*b*, the body 60 of the movement measurement device 16 is rotatably connected to a housing 64 by an axle 66. The housing 64 has an open end 68 and a window end 70 preferably positioned directly opposite the open end 68. The continuous surface 62 of the body 60 has body indicia 74 positioned thereon, including pictures, letters, numbers, or other symbols, with the body indicia 74 visible through the window end 70 of the housing 64 and the open end 68 of the housing 64. One rotation of the body 60 is the equivalent of one space.

Figure 9A:
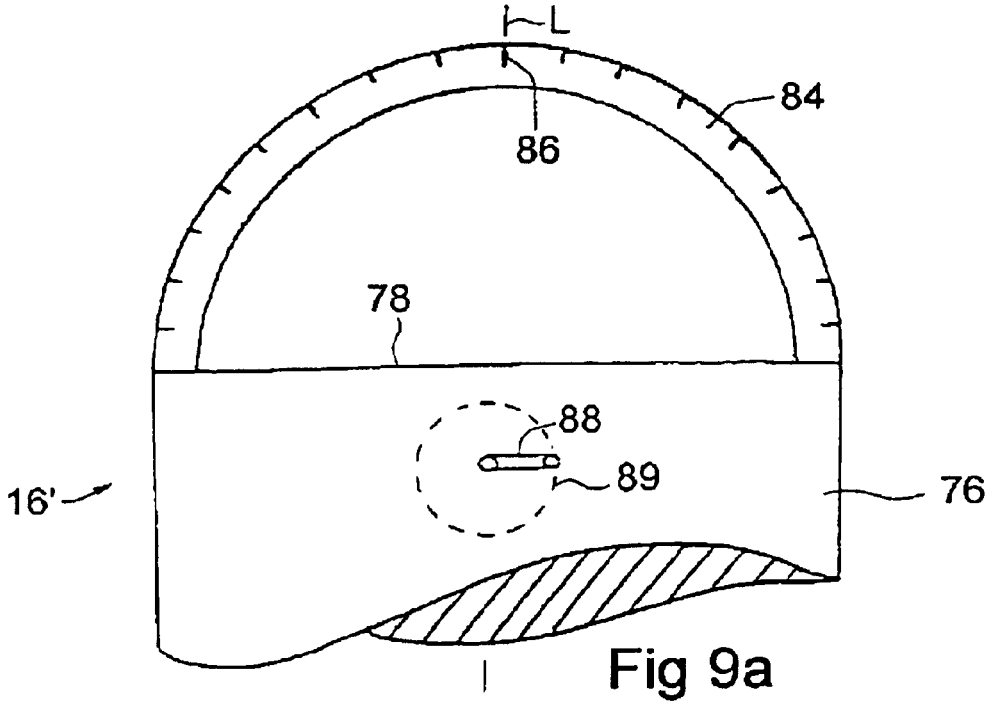
FIG. 9*a* is a side view of a second embodiment movement measurement device.
Figure 9B:
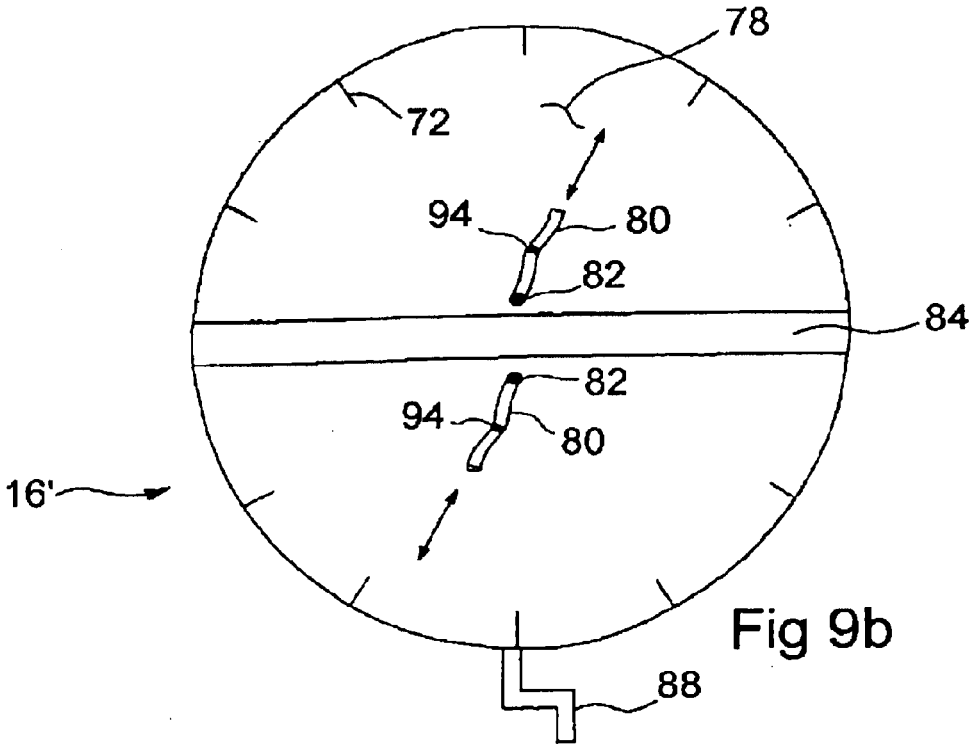
FIG. 9*b* is a top view of the movement measurement device shown in FIG. 9*a;*

FIGS. 9*a* and 9*b* show a second embodiment of a movement measurement device 16' that measures range values R in three dimensions. The second embodiment generally includes a base 76 having at least one retractable measurement line 80 positioned adjacent an origin 82, base indicia 72, and a first semi-circular member 84 positioned adjacent the base 76. The base 76 rotates 360° about a longitudinal axis L, the first semi-circular member 84 has member indicia 86 positioned thereon, and the retractable measurement line 80 is extendable and retractable with respect to the base 76, as shown by the arrows. Each measurement line 80 is retracted with a corresponding hand crank 88 attached to a retractor pulley 89 or other suitable mechanisms.

In operation, one or more retractable measurement lines 80 having measurement indicia 94 are pulled from the base 76 and aligned with the base or member indicia 72, 86 positioned adjacent the base 76 or first semi-circular member 84. The direction and length of the retractable measurement line or lines 80, measured from the origin 82 of the base 76 into an adjacent space using the measurement indicia 94, indicates range R.

Figure 10A:
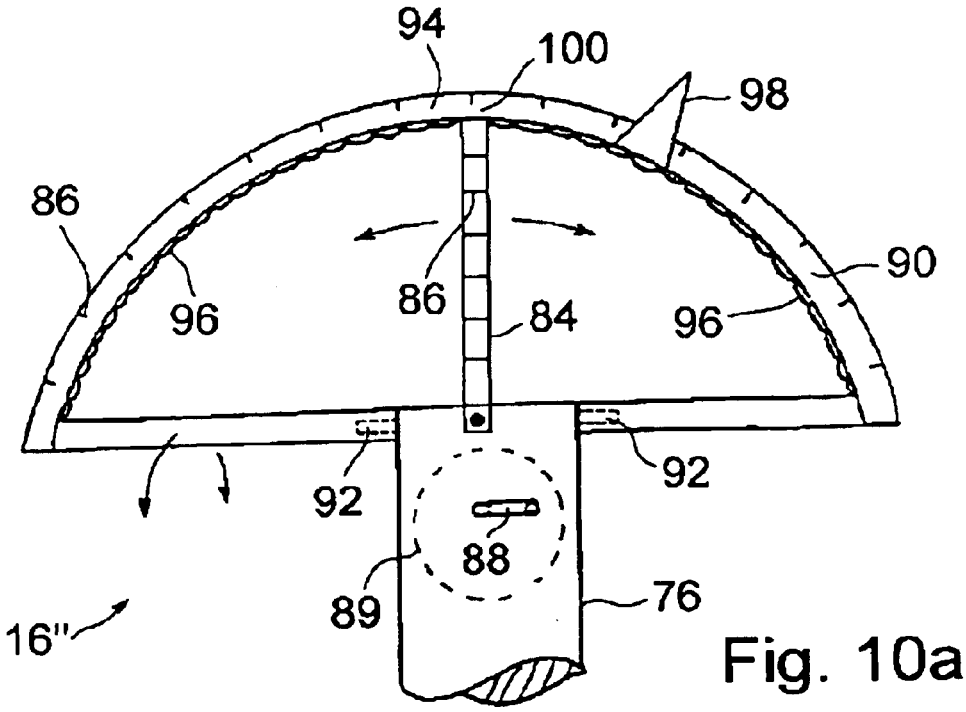
FIG. 10*a* is a top view of a third embodiment movement measurement device.
Figure 10B:
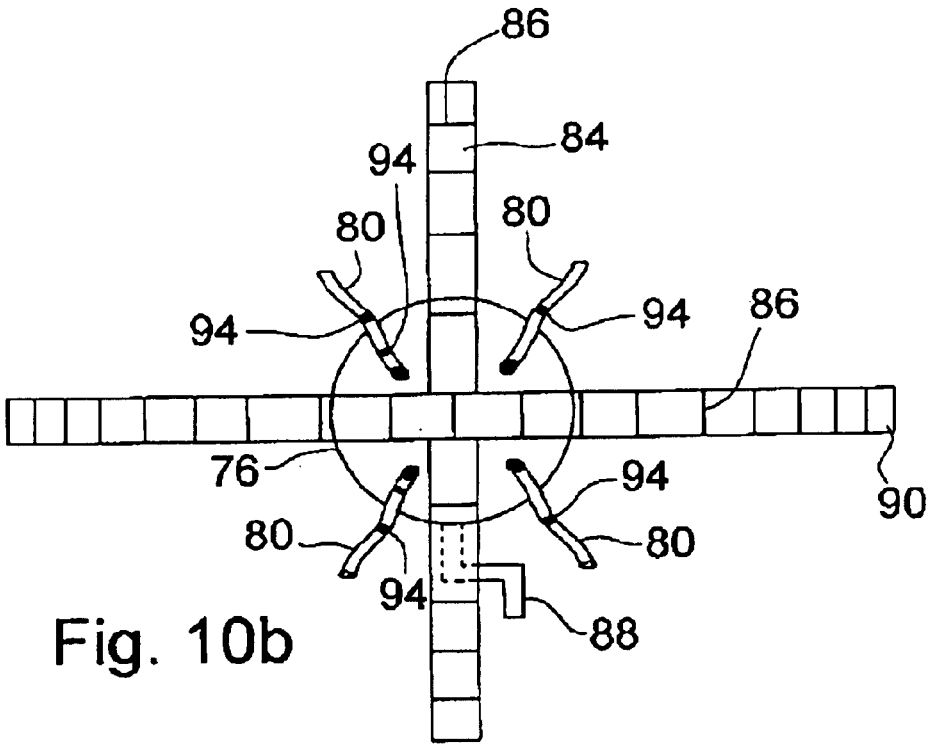
FIG. 10*b* is a side view of the movement measurement device shown in FIG. 10*a;*

FIGS. 10*a* and 10*b* show a third embodiment of a movement measurement device 16" that also measures range value R in three dimensions. This embodiment generally includes the same structural elements as the second embodiment, such as a base 76 having at least one retractable measurement line 80 positioned adjacent an origin 82 and a first semi-circular member 84 positioned adjacent the base 76. It further includes a second semi-circular member 90 positioned adjacent the first semi-circular member 84, wherein the first and second semi-circular members 84, 90 are movable with respect to the base 76 and each other. The first semi-circular member 84 has member indicia 86 positioned thereon and the retractable measurement lines 80 are extendable and retractable with respect to the base 76.

Each semi-circular member 84, 90 is movably attached to the base 76 by pins 92, with an arc of the first semi-circular member 84 circumscribed by an arc of the second semi-circular member 90. This configuration allows the first and second semi-circular members 84, 90 to move 180° in first and second directions with respect to the base 76, as indicated by the arrows. The second semi-circular member 90 may have protrusions 96 and member indicia 86. The second semi-circular member 90 may also have snub-nosed movement pointers 98 positioned thereon. The protrusions 96 help keep the two semi-circular members 84, 90 together after being rotated about the pins 92, as indicated by the arrows.

In operation, the first and second semi-circular members 84, 90 are pivoted about the base 76 or otherwise moved with respect to one another. A retractable measurement line 80 is pulled from the base 76 and aligned directly adjacent the intersection 100 of the first and second semi-circular members 84, 90, optionally guided by a movement pointer 98. The direction and length of the retractable measurement line 80, measured from the origin 82 of the base 76 into an adjacent space, indicates the range value R.

The second and third embodiments of the movement measurement device permit range value measurements in three dimensions, such as measuring between a game piece on a first level of a structure and a game piece positioned adjacent a higher level of the structure. These embodiments 16', 16" can also be used in other games or variations thereof, such as measuring between a ground level and flying objects, such as blimps, airplanes, or rockets. Moreover, although any of the movement measurement devices 16, 16', 16" discussed above are preferably separate pieces, any of the embodiments may also be incorporated into one or more game pieces 14.

The game begins with the construction of a structure, such as a tower 18. In the preferred embodiment, the tower 18 has thirteen layers of structural units 12, with each layer preferably stacked upon a portion of the preceding layers. To aid in construction of the tower 18, any of the structural unit guides 10 previously discussed can be used. However, any free-standing or other structure may be built with or without the use of structural unit guides 10.

A structural unit guide 10' corresponding to a first level of the tower 18 is positioned on a horizontally level surface, such as a floor or table top. The structural unit guide 10 has structural unit guide indicia 24 positioned on either the top side or bottom side of the structural unit guide 10. For example, as illustrated in FIG. 6, a structural unit 12 having a structural unit indicia 26 "A" thereon is positioned over a corresponding available space 28 on the structural unit guide 10 also having the structural unit guide indicia 24 "A". In cases where the structural units 12 are preferred to have a given orientation, a dot or other structural unit indicia 26 is positioned on the structural unit and a corresponding dot (shown in FIG. 4) or other structural unit guide indicia 24 is positioned on the structural unit guide 10. The dots are then positioned directly opposite each other during construction.

Each subsequent structural unit 12 is then positioned over an available space 28 corresponding to the shape of the structural unit 12, defined by both the structural unit guide indicia 24 on the structural unit guide 10 and the structural unit indicia 26 positioned on each structural unit 12. This process is repeated until the available spaces 28 on the structural unit guide 10 are filled, forming a first layer of structural units 12.

A structural unit guide 10 corresponding to a second level of the tower 18 is then placed adjacent the first layer of structural units 12. When the second structural unit guide 10 is filled with structural units 12, the process continues until the tower 18 is completed.

Once the tower 18 is complete, each player or group of players chooses a side and the order of turns. Once sides have been chosen, each of the players or groups of players assemble their game pieces 14 inside or outside of the tower 18, determined by their respective sides. For example, the game piece 14 designated as the King 42 is strategically positioned at the players' discretion anywhere around the perimeter of the tower 18, approximately twenty-four (24) spaces away from the tower 18 as measured by any of the movement measurement devices 16, 16', 16". The game pieces 14 representing the King's troops 46, 48 are then positioned within six (6) spaces away from the King 42. Conversely, the Dragon's 50 henchmen 52, 54 are positioned at any point inside or outside of the tower 18, but preferably physically touching the tower 18.

In order to prevail, the players or group of players controlling the King 42 and his troops must retake the tower 18 by removing, through capture, the henchmen 52, 54 from play. Conversely, the purposely outnumbered henchmen 52, 54 are tasked with repelling the King 42 and his troops 46, 48. Therefore, confrontation is a necessary consequence.

All of the game pieces 14 controlled by each side are moved per turn, up to the maximum movement values indicated by the game piece indicia 40 positioned on each of the game pieces 14. The player or group of players controlling the King 42 moves the King 42 and his troops 46, 48 during his or their turn. As shown in FIG. 11, game pieces 14 cannot move through solid objects, such as other game pieces 14 or structural units 12 of the tower 18 and castle 20, so game pieces 14 must go around any obstructions, with the exception of intentional contact between game pieces 14 for the purpose of engaging in mathematical combat. A game piece 14 can, however, move through holes in structural units 12 created by the catapult 56, pre-existing holes in the tower 18 and castle 20, or natural entranceways, such as bridges.

Once one side's game pieces 14 have been moved, the player or group of players moving the game pieces 14 may then engage in mathematical, non-deadly combat with game pieces 14 controlled by the opposing player according to the following guidelines.

When a game piece 14 has been overtaken by an opposing game piece 14 and the two opposing game pieces 14 are touching one another, or, as shown in FIG. 12, when an opposing game piece 14 is within the range R of a game piece 14 capable of launching imaginary projectiles, the two game pieces 14 engage in mathematical combat. In the case of two opposing game pieces 14 touching one another, a player on each opposing side rolls two dice. The total number rolled by each side is then added to the maximum attack value of the game piece 14 controlled by the respective sides. For example, as shown in FIG. 12, the King 42 game piece 14 is touching a Bad Archer 54 game piece 14. The player or group of players controlling the King 42 game piece 14 rolls two dice, generating a four and a two. The four and the two are added to the maximum attack value positioned on the King 42 game piece 14, a ten, to reach a grand total of sixteen. Similarly, if the player or group of players controlling the Bad Archer 54 rolls a six and a six, for a total roll of twelve, twelve is added to the attack value of the Bad Archer 54, five, for a total of seventeen. In this instance, the Bad Archer 54 wins the battle, since thirteen is greater than eleven, and the King 42 game piece 14 is removed from play.

In another example of mathematical combat, as shown in FIG. 12, the Dragon 50 game piece 14 is within eight (8) spaces, as measured by any of the movement measurement devices 16, 16', 16", of the Good Archer 48 game piece 14. The maximum attack range value R of the Good Archer 48 game piece 14 is ten (10) spaces; therefore, the Dragon 50 game piece 14 can be attacked. The combat result is determined in the same manner as when two game pieces 14 are in physical contact with one another, namely two dice are rolled by each opposing player or group of players and the respective sums are added to the attack value of the respective game piece 14. If the total sum attributed to the Good Archer 48 is higher than the total sum attributed to the Dragon 50, the Dragon 50 game piece 14 is removed. If the total sum attributed to the Dragon 50 is higher, then no game pieces 14 are removed. A similar result occurs if there is a tie.

To further provide a tactical advantage to either side, up to three game pieces 14 from the same side can be combined together (positioned so the game pieces 14 are touching one another) and their cumulative attack values added to the sum of the two dice. This is shown in FIG. 12, where the Queen 44 and Knight 46 game pieces 14 are combined. However, the combination of game pieces 14 should not be permitted to move as a unit.

When the mathematical battle, if any, is complete, the opposing side is then given the opportunity to move their game pieces 14 and launch their own counter-attack.

In a shortened version of play, the attack values positioned on the game pieces 14 can be substituted with the classification of the game piece 14, indicated by the game piece indicia 40. During this optional mathematical combat, game pieces 14 having an "A" classification automatically capture game pieces 14 having a "B" classification. Game pieces 14 with a "B" classification automatically capture game pieces 14 having a "C" classification, and game pieces 14 with a "C" classification automatically capture game pieces 14 having an "A" classification.

At the conclusion of play at the tower 18, indicated by the capture of all of the game pieces 14 controlled by one player or group of players, the tower 18 is disassembled and the castle 20 is erected. The castle 20, shown in FIGS. 2–3, is built using the same structural units 12 that previously constituted the tower 18, preferably using structural unit guides 10. In the preferred embodiment, game pieces 14 removed from play at the tower 18 are returned to the game. The object of the game, at this point, is for the King 42 and his troops 46, 48 to free the Queen 46 and the Prince who are being held captive.

After the castle 20 has been erected, the game piece 14 representing the Dragon 50 is positioned inside the castle 20, and the henchmen 52, 54 are positioned anywhere within or outside tower 18 walls or moats of the castle 20. The game pieces 14 representing the King 42 and his troops 46, 48 are positioned anywhere outside of the castle 20, within twenty-four (24) spaces, as measured by a movement measurement device 16, 16', 16". The catapult 56 is also positioned anywhere within twenty-four (24) spaces of the castle 20.

The capture of game pieces 14 occurs in the same manner as disclosed in the tower 18 portion of the game. However, if the Dragon 50 or henchmen 52, 54 game pieces 14 attempt to capture the catapult 56 and lose, the Dragon 50 or henchmen 52, 54 game pieces 14 are not removed, since the catapult 56 is inanimate and cannot fight back.

The catapult 56 can only attack the structural units 12 of the castle 20 from the top down. Every time a player or group of players controlling the catapult 56 game piece 14 rolls a total of four or higher, and is within the projectile range value R of the catapult, a structural unit 12 within the range R is removed from the castle 20. Similarly, if the King 42 or his troops 46, 48 touch the castle 20 or tower 18, a structural unit 12 on the top of the tower 18 or castle 20 is removed for each turn that the game piece 14 remains in contact with the tower 18 or castle 20.

The game ends when the players or groups of players controlling one side have lost all of their game pieces 14 or when the Dragon 50 game piece 14 and the henchmen 52, 54 flee the castle 20 and do not attempt to regain control after ten (10) turns.

As recited above, the present invention provides an interactive, educational game that encourages input from the players and allows the players to make their own decisions, choose their own strategies, and directly affect the outcome of the game. Each player or side is free to orient and move their game pieces 14 in linear and non-linear directions in order to triumph over their opponent. In the process of playing the game, players match shapes and symbols, multiply or add, assemble structures (either designed or original), measure range value R in two or three dimensions, and think ahead of their opponents.

The described game represents one embodiment of the present invention. The basic, storyline, structure, game characters, and battle resolution rules can be easily modified with the elements of the present invention. For example, the flexibility provided by the movement measurement devices 16, 16', 16" allows the elements of the present invention to be effectively used in a navel engagement scenario or a desert tank battle scenario or many other military or non-military scenarios.

The invention has therefore been described with reference to the preferred embodiments. Obvious modifications and alterations will occur to others upon reading and understanding the preceding detailed description. It is intended that the invention be construed as including all such modifications and alterations insofar as they come within the scope of the appended claims or the equivalents thereof.

I claim:

1. A game comprising:

at least one structural unit guide;

a plurality of structural units positioned adjacent said at least one structural unit guide, said structural units forming a structure;

a plurality of movable game pieces positioned in proximity to said structure; and a movement measurement device constructed to measure range values of said game pieces, wherein said movement measurement device has a body having a continuous surface.

2. The game as claimed in claim 1 wherein each said structural unit guide is made from a planar material.

3. The game as claimed in claim 1 wherein each said structural unit guide is a three-dimensional structure forming hollow cavities corresponding to an outer periphery shape of one or more said structural units.

4. The game as claimed in claim 1 wherein each said structural unit guide has structural unit guide indicia that corresponds with corresponding to structural unit indicia positioned adjacent each structural unit.

5. The game as claimed in claim 1 wherein said structural units form three-dimensional geometric shapes selected from a group consisting of rectangular, elongated, wedged, arced, and arched.

6. The game as claimed in claim 1 wherein said structural units and said game pieces are interchangeable.

7. The game as claimed in claim 1 wherein said game pieces each have game piece indicia positioned thereon, said indicia indicating attack and range values corresponding to said game piece.

8. The game as claimed in claim 1 wherein at least one of said game pieces has movable body members.

9. The game as claimed in claim 1 wherein said continuous surface has body indicia positioned thereon for measuring linear, non-linear and random motion.

10. A method of playing a game comprising the steps of:

a) building a multi-layer structure using stacked layers of structural units and a plurality of structural unit guides with at least one structural unit guide forming a guide for positioning the structural units in each layer of the multi-layer structure;

b) assembling game pieces in proximity to said structure;

c) determining range values for each game piece using a movement measurement device;

d) moving each game piece within a permissible movement range value;

e) engaging in mathematical combat with game pieces controlled by an opposing side; and f) removing captured game pieces from play.

11. The method as claimed in claim 10 wherein said movement measurement device has a base having a plurality of retractable measurement lines each positioned adjacent an origin; and a first semi-circular member positioned adjacent said base, wherein said base rotates 360° about a longitudinal axis, said first semi-circular member has indicia positioned thereon, and said retractable measurement lines are extendable and retractable with respect to said base.

12. The method as claimed in claim 10 wherein said movement measurement device has a base having a plurality of retractable measurement lines each positioned adjacent an origin;

a first semi-circular member positioned adjacent said base; and a second semi-circular member positioned adjacent said first semi-circular member, wherein said first and second semi-circular members are movable with respect to said base and each other, said first semi-circular member has indicia positioned thereon, and said retractable measurement lines are extendable and retractable with respect to said base.

13. A game comprising:

a plurality of distinct moveable game pieces, each said movable game piece having defined range values that define movement parameters for said moveable game piece; and a movement measurement device for said game having said distinct moveable, game pieces, said movement measurement device constructed to measure range values of said moveable game pieces, wherein said movement measurement device is a body having a continuous surface, said continuous surface, having body indicia positioned thereon and constructed to roll along a playing surface to measure said range values of said moveable game pieces.

14. The game as claimed in claim 13 wherein said movement measurement device is adapted to measure linear, non-linear and random motion in solid planar and non-planar environments by movement along the path of the measured range.

15. The game as claimed in claim 14 wherein said continuous surface is the periphery of a circular wheel.

16. The game of claim 13 wherein the movement measurement device is incorporated into at least one said game piece.

17. The game of claim 16 wherein each said game piece includes human and/or animal figures.

18. A game comprising:

a plurality of distinct game pieces, each said game piece having defined range values that define movement parameters for said game piece; and a movement measurement device for said game having said distinct game pieces, said movement measurement device constructed to measure range values of said game pieces, wherein said movement measurement device is a base having at least one retractable measurement line positioned adjacent an origin, further including at least one semi-circular member positioned adjacent said base, wherein each said semi-circular member has indicia positioned thereon, and each said retractable measurement line is extendable and retractable with respect to said base, wherein said measurement line when extended from, said base measures said range values of said game pieces in three dimensions.

19. A structural guide system for building a specific toy, multi-layer simulated structure formed of stacked layers of toy structural units that can form a variety of simulated structures, said system including a plurality of structural unit guides, wherein each structural unit guide is associated with layer of the specific multi-layer structure with each said guide including guide indicia identifying the location of a plurality of structural units which form said layer and wherein said plurality of structural units forming said layer are placed adjacent said structural unit guide associated with said layer, and wherein structural unit guides are incorporated into the simulated structure.

20. The system of claim 19 wherein each said guide is formed of a planar material.

* * * * *